US006422771B1

(12) United States Patent
Chvojcsek et al.

(10) Patent No.: US 6,422,771 B1
(45) **Date of Patent: *Jul. 23, 2002**

(54) DISPOSABLE RIBBON CARTRIDGE FOR SHORTHAND MACHINE

(75) Inventors: Frank Chvojcsek, West Dundee, IL (US); Van E. Sun, Palo Alto, CA (US)

(73) Assignee: Stenograph Corporation, Mount Prospect, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/768,091

(22) Filed: Dec. 16, 1996

Related U.S. Application Data

(63) Continuation of application No. 08/768,091, filed on Dec. 16, 1996, now abandoned, which is a continuation of application No. 08/581,308, filed on Dec. 28, 1995, now abandoned, which is a continuation of application No. 08/389,739, filed on Feb. 15, 1995, now abandoned, which is a continuation of application No. 08/091,533, filed on Jul. 14, 1993, now abandoned, which is a continuation of application No. 07/822,638, filed on Jan. 17, 1992, now abandoned.

(51) Int. Cl.[7] ..... B41J 33/382
(52) U.S. Cl. ..... 400/235; 400/194; 400/208
(58) Field of Search ..... 400/194, 196, 400/196.1, 202.4, 207, 208, 234, 235, 223, 202.2

(56) References Cited

U.S. PATENT DOCUMENTS

| | | | | | |
|---|---|---|---|---|---|
| 2,319,273 | A | | 5/1943 | Sterling | 400/194 |
| 2,891,647 | A | * | 6/1959 | Smith | 400/194 |
| 4,042,092 | A | * | 8/1977 | Newman | 400/194 |
| 4,289,413 | A | * | 9/1981 | Seplin | 400/202.4 |
| 4,469,456 | A | * | 9/1984 | Fitzgerald | 400/194 |
| 4,636,097 | A | * | 1/1987 | Goubeaux | 400/196.1 |
| 4,653,947 | A | * | 3/1987 | Echols | 400/196.1 |
| 4,794,409 | A | * | 12/1988 | Cowger et al. | 346/140 R |
| 5,005,996 | A | * | 4/1991 | Paterra et al. | 400/196.1 |
| 5,207,519 | A | * | 5/1993 | Debreczenyi | 400/202.4 |
| 5,215,012 | A | * | 6/1993 | Kanno et al. | 400/196.1 |

FOREIGN PATENT DOCUMENTS

| | | | | |
|---|---|---|---|---|
| JP | 007373 | * | 1/1991 | 400/196 |

* cited by examiner

*Primary Examiner*—Ren Yan
(74) *Attorney, Agent, or Firm*—McDermott, Will & Emery

(57) ABSTRACT

A disposable ink ribbon cartridge for use in a shorthand machine. The cartridge includes an endless loop ribbon threaded through an advancing mechanism in contact with a movable ink reservoir. The advancing mechanism advances the ribbon and also transfers ink from the ink reservoir to the ribbon. The ink reservoir is made from a reticulated foam which provides an even supply of ink over a long period of time. The movable ink reservoir and the advancing mechanism interact to minimize friction between the moving parts of the cartridge. The ink reservoir and advancing mechanism deliver consistent and even doses of ink to the ribbon throughout the life of the cartridge.

2 Claims, 5 Drawing Sheets

DISPOSABLE RIBBON CARTRIDGE FOR SHORTHAND MACHINE

This application is a continuation of application Ser. No. 08/768,091, filed Dec. 16, 1996, now abandoned, which was a continuation of application Ser. No. 08/581,308, filed Dec. 28, 1995, now abandoned, which was a continuation of application Ser. No. 08/389,739, filed Feb. 15, 1995, now abandoned, which was a continuation of application Ser. No. 08/091,533, filed Jul. 14, 1993, now abandoned, which was a continuation of application Ser. No. 07/822,638, filed Jan. 17, 1992, now abandoned.

BACKGROUND OF THE INVENTION

This invention relates in general to ink ribbons used in shorthand machines. In particular, this invention relates to an efficient and disposable ribbon cartridge for use in shorthand machines.

Shorthand machines are commonly used to record spoken words in a visual form. For example, stenographers typically use shorthand machines to record statements made in depositions, hearings and other court-related proceedings. Shorthand machines manufactured by the assignee of the present invention have operated successfully and efficiently for many decades.

The conventional shorthand machine has a keyboard of twenty-two phonetically-related characters which, to the skilled operator, provides all combinations necessary to record words and numbers. The record produced by-the machine may be a paper tape on which the phonetic characters are printed, or the characters may be recorded on a magnetic tape medium. One example of paper recording is generally described in U.S. Pat. No. 2,319,273, which was assigned to the predecessor of the assignee of the present invention. One example of magnetic recording is generally described in U.S. Pat. Nos. 3,557,927 and 4,205,351, also assigned to the assignee of the present invention.

To record a word or parts of a word in a conventional shorthand machine, the machine operator presses an appropriate combination of the keys, and the machine mechanically prints the characters simultaneously on a paper tape, or in the case of electric recordation, combinations of electrical-pulses are recorded on a magnetic tape or disk medium. For paper tape recordation, the keys actuate associated type bars to cause the type bars to impact on an inked ribbon to print characters on the paper.

The ribbon for a shorthand machine is typically an "endless loop" design. The general principal of the endless loop is to utilize a single ribbon in a closed circle as described and illustrated in U.S. Pat. No. 2,319,273 ('273 patent). The entire disclosure of the '273 patent is incorporated herein by reference.

As best shown in FIG. 5 of the '273 patent, the ribbon 28 passes around a ribbon spool 173 and between a platen 27 and asset of type bars 73. A fabric 196 is wrapped around the core of the spool to absorb ink from the spool and impart the ink to the ribbon as it contacts the fabric. Ink is provided to the spool via openings in the top of the spool. The user must periodically replenish the ink in the spool through the openings. A pair of ribbon pressure rolls 222 and 223 force the ribbon against the ink-filled fabric on the spool. A mechanical connection (described in detail at col. 11, line 16 to col. 12, line 27) between the spool and the keys rotates the ribbon spool whenever keys are pressed, thereby advancing the ribbon around the spool (via pressure rolls) and through the print area. The platen 27 holds paper for printing, and the type bars 73 are each associated with one of the keys. When a key is pressed, the associated type bar is urged toward the platen, thereby urging the ribbon into contact with the paper on the platen for printing characters on the paper.

In contrast to the typical synthetic typewriter ribbon, which is inked and printed once, the endless loop ribbon is made from an absorbent fabric which is continuously cycled through the print area and replenished with ink. Thus, a given area of the endless loop ribbon is printed on several thousand times during the useful life of the ribbon.

Although a significant amount of a shorthand machine's functions are controlled electronically, many functions—such as ribbon advancement, print hammer movement and platen advancement—are controlled mechanically, or at least provided with a mechanical (manual) mode. Having mechanical functions allows the shorthand machine to be used in places where electrical service is non-existent, inconvenient, or unreliable. Additionally, the mechanically driven functions typically make less noise than the electrically driven functions. This is important because in most applications, particularly in court reporting, it is essential that the shorthand machine operates as quietly as possible.

Because the endless-loop ribbon is advanced mechanically by pressing the keys, it is important to minimize the force required to advance the ribbon. Thus, it is advantageous to provide a minimum amount of friction between the moving parts of the advancing mechanism so that the force required to depress the keys is also minimized.

The Xscribe Corporation has sold an endless-loop-based cartridge for use with its Stenotype® family of shorthand machines. The Stenotype cartridge includes a relatively long ribbon which is folded at right angles to create a 90° change of direction for the ribbon. The ribbon is advanced through the cartridge by passing between and engaging a drive gear and an idle gear. The idle gear transfers ink to the ribbon by rubbing against a stationary ink-holding foam stem which acquires its ink from an apparently rectangular and stationary ink reservoir.

Several problems are associated with the Stenotype® cartridge, the most important of which is the amount of force required to advance the ribbon through the cartridge. For example, the contact between the stationary ink stem and the idle gear creates a significant amount of unwanted friction in the advancing mechanism. Additional friction is generated when the ribbon is pulled through its 90° bend. Also, the extremely long ribbon is confined within the relatively small Stenotype® cartridge by providing a holding area for the ribbon inside the cartridge. The ribbon is literally bunched and packed into the holding area and must be pulled through this area by the single drive/idle gear combination. Thus, the Stenotype® machine includes a motor driven ribbon advancing mechanism (electric mode) in addition to a mechanical key-driven ribbon advancing mechanism (manual mode). In the manual mode, the force required to depress the Stenotype's keys could become unacceptable for the operator during extended use.

Additionally, the Stenotype cartridge's ribbon tends to have heavy ink in some areas and light ink in other areas, resulting in a rather messy cartridge and inconsistent print quality. This is apparently due to the fact that the ribbon is bunched in the holding area such that ink is allowed to migrate randomly from one portion of the ribbon to another. Also, the stationary ink stem is itself easily saturated with ink from the ink reservoir, resulting in a non-uniform transfer of ink to the idle gear and further contributing to inconsistent print quality.

Thus, it is an object of the present invention to provide an endless-loop ribbon cartridge that takes full advantage of the benefits associated with utilizing a cartridge. It is also an object of the present invention to provide an endless-loop ribbon cartridge that does not significantly increase the amount of force required to depress the shorthand machine's keys. It is a further object of the present invention to provide a ribbon cartridge that supplies an even distribution of ink to the ribbon. Additionally, it is an object of the present invention to provide a ribbon cartridge having a relatively long life and requiring little or no maintenance.

SUMMARY OF THE INVENTION

The present invention is directed to a disposable ribbon cartridge for use in a shorthand machine. The cartridge comprises a housing having an endless loop ribbon extending through a prescribed pathway in the housing. An advancing mechanism advances the ribbon through its prescribed pathway, and also transfers ink from a movable ink reservoir to the ribbon. The ink reservoir is preferably made from a reticulated and felted polyurethane foam having specific wicking properties.

BRIEF DESCRIPTION OF THE DRAWINGS

The invention is described in greater detail in the following description of the preferred embodiment, taken in conjunction with the drawings, in which.

DESCRIPTION OF THE PREFERRED EMBODIMENT

Operating Environment

Figure 1:
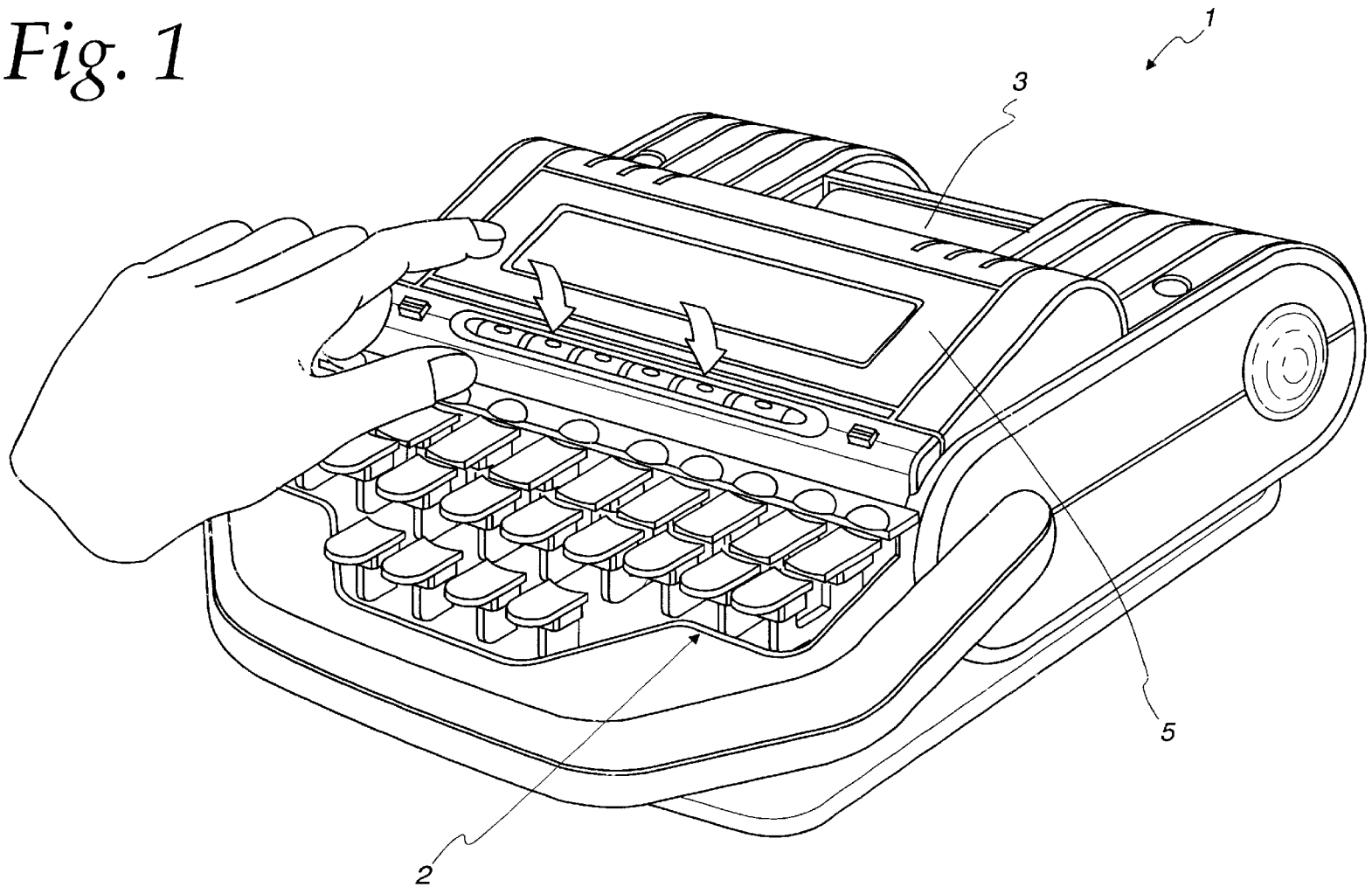
FIG. 1 shows a shorthand machine for use with the ribbon cartridge embodying the present invention.
Figure 2:
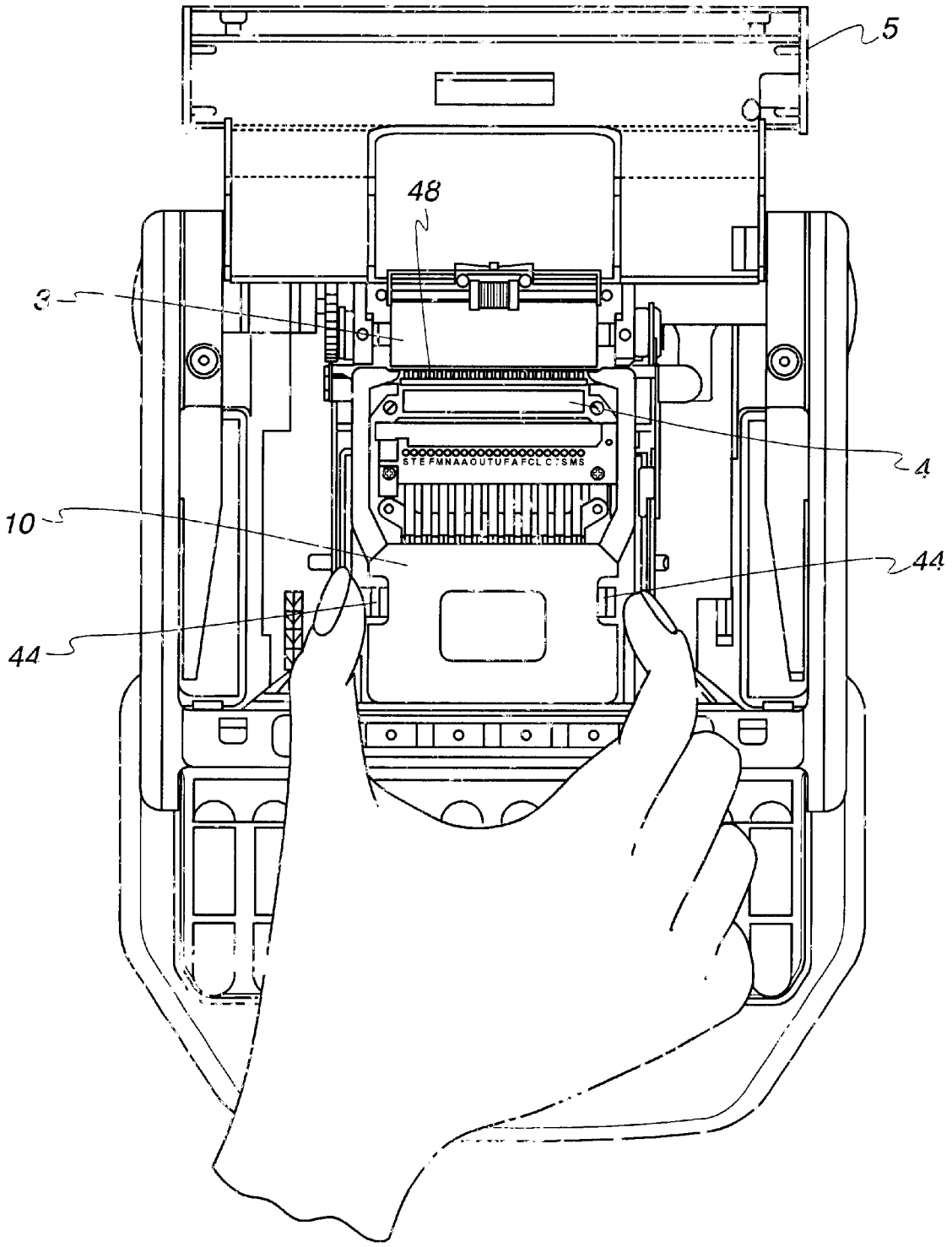
FIG. 2 shows the shorthand machine of FIG. 1 with its cover open. A user is placing a ribbon cartridge embodying the present invention inside the shorthand machine.
Figure 3:
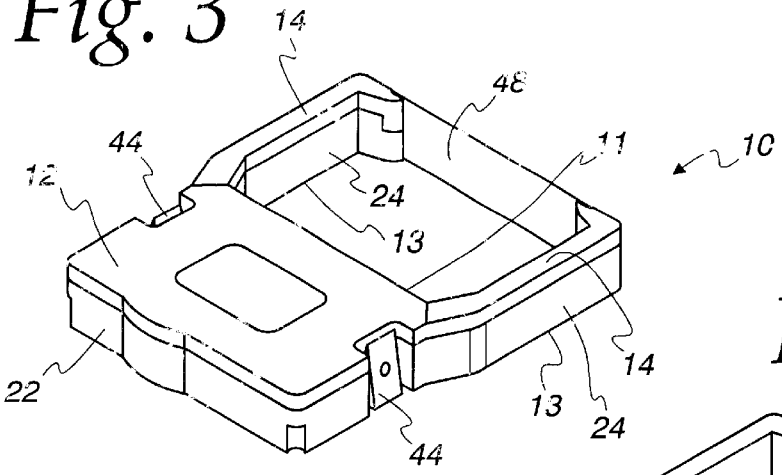
FIG. 3 is a top perspective view of the ribbon cartridge shown in FIG. 2.

This invention may be implemented in any conventional shorthand machine. The embodiment disclosed herein is particularly suitable for use with the Stenograph® STENTURA™ family of shorthand machines, an example of which is illustrated in FIGS. 1 and 2. Many of the mechanical and electrical features of the STENTURA™ are described in U.S. Pat. No. 2,319,273; 3,557,927; 4,205,351; 4,421,427 and 4,363,558, and the entire disclosure of each of these patents is incorporated herein by reference. Additional details regarding the STENTURA™ are described in co-pending, commonly assigned U.S. Patent application Ser. No. 07/822,293, filed Jan. 17, 1992, entitled "Method and Apparatus for Recording and Translating Shorthand Notes." The entire disclosure of application Ser. No 07/822,293 is incorporated herein by reference.

A shorthand transcribing machine for use with the ribbon cartridge embodying the present invention is illustrated in perspective in FIG. 1 and is designated in general by the reference numeral 1. The shorthand machine 1 is shown in FIG. 2 with its cover raised, exposing the ribbon cartridge 10 embodying the present invention in place inside the machine 1. In general, the shorthand machine 1 includes a keyboard 2 having a plurality of keys which, when stroked by an operator, produce a paper tape record of the words recorded. Each key represents an alpha-numeric symbol which is reproduced at the paper tape when the key is stroked by the operator.

The paper tape (not shown) is carried over a rubber platen 3. A type bar 4 is associated with each key and is advanced toward the platen 3 when the particular key is stroked. The cartridge 10 includes an internal advancing mechanism 50 (shown in FIGS. 5*a* and 5*b*) for feeding an inked ribbon 48 between the type bars 4 and the platen 3. The advancing mechanism 50 is driven by a mechanical connection to the keys so that the ribbon 48 is advanced each time a key is depressed. Also, the paper tape is advanced by a mechanically or electrically driven mechanism for rotating the platen 3 each time the one or more of the keys is stroked. The type bars associated with the stroked keys urge the inked ribbon into contact with the paper at the platen 3 for impressing an ink symbol thereon.

As shown in FIG. 2, the cartridge fits directly under the cover 5 in the area previously occupied by the ink spool and pressure rolls described in the '273 patent. The cartridge 10 is secured in the machine 1 by tabs 44 located on the sides of the cartridge. The cartridge 10 is conveniently held by grasping the tabs 44 with the thumb and index fingers. The tabs 44 are then pressed toward one another as the cartridge 10 is lowered. The tabs 44 move past and then engage a pair of complementary flanges (not shown) in the machine 1.

Figure 4:
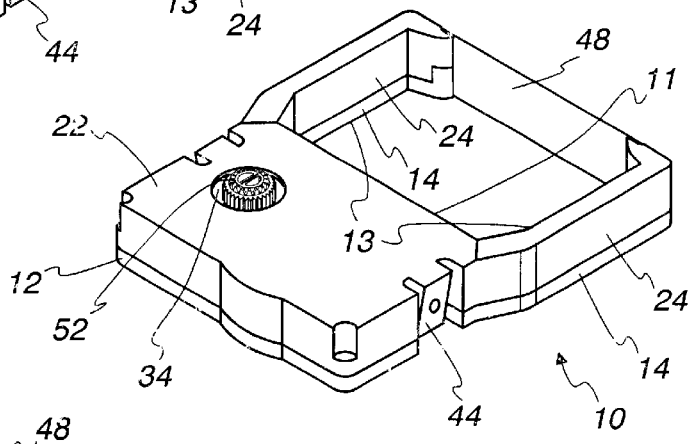
FIG. 4 is a bottom perspective view of the ribbon cartridge shown in FIG. 2.

FIG. 4. illustrates a perspective view of the bottom of the cartridge 10. A small opening 34 in the cartridge 10 exposes the drive teeth 62 on the advancing gear 52. When the cartridge 10 is in place inside the machine 1, a pinion 66 (shown in FIG. 6) engages the teeth 62. A mechanical connection (not shown) between the pinion 66 and the keyboard 2 rotates the pinion 66 whenever a key is depressed, thereby rotating the advancing gear 52 and advancing the ribbon 48. An ink reservoir 112 (shown in FIGS. 5*a* and 5*b*) is located inside the cartridge 10 and continuously and evenly provides ink to the ribbon 48 in a manner to be described.

Cartridge Construction

Figure 5A:
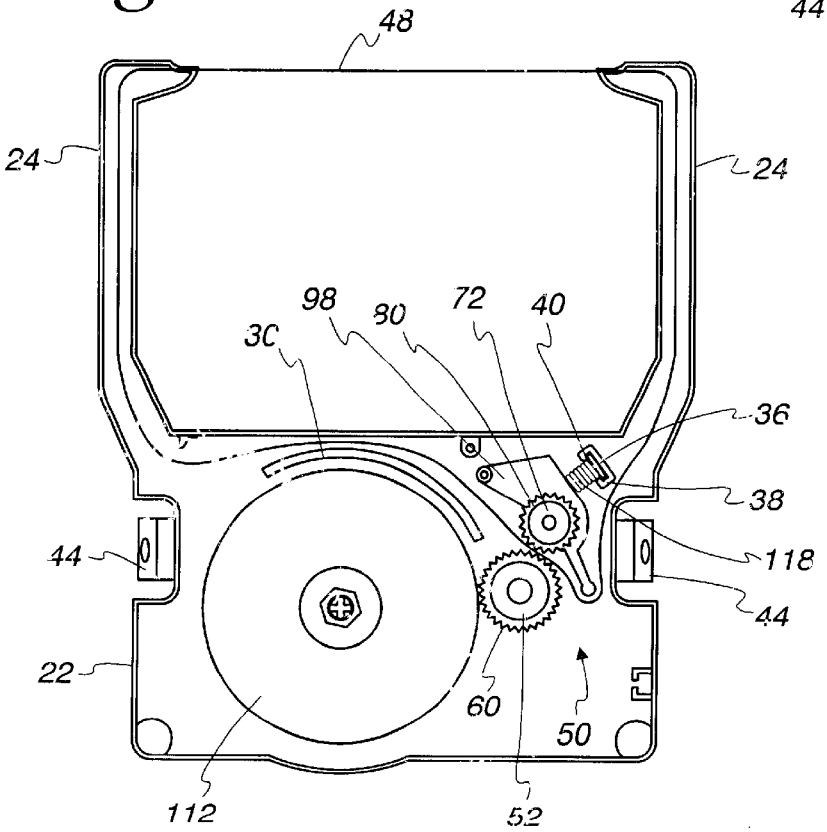
FIG. 5*a* is a top plan view of the cartridge shown in FIG. 2 with its top portion removed.
Figure 5B:
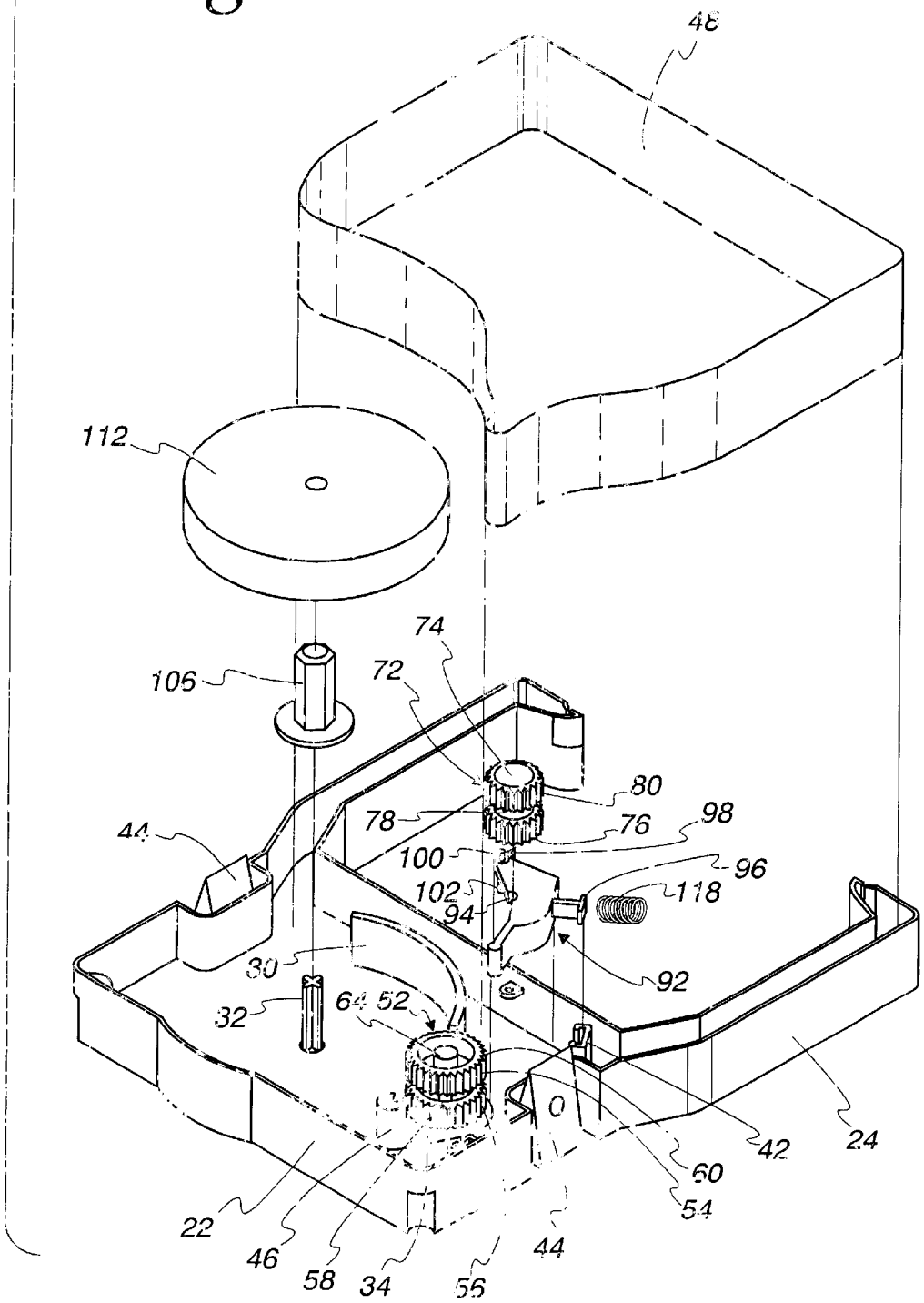
FIG. 5*b* is an exploded view of the components of the ribbon cartridge shown in FIG. 2.
Figure 6:
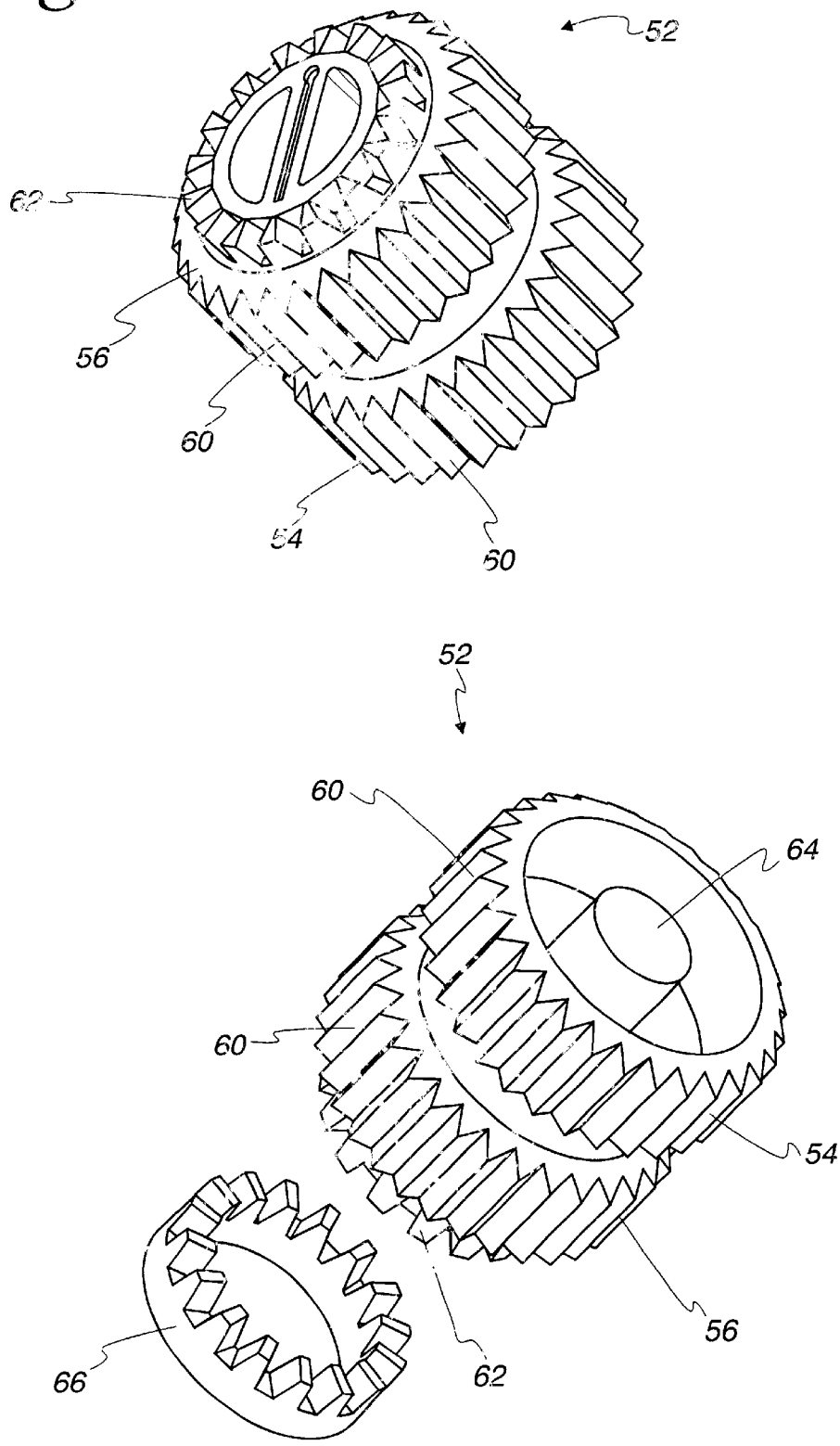
FIG. 6 is a perspective view of the drive gear shown in FIGS. 5*a* and 5*b*.

The cartridge 10 includes two sections 12, 22, best illustrated in FIG. 5*a*. The top section 12 generally includes a pair of arms 14 and a body 15. The bottom section 22 of the cartridge 10 includes a pair of arms 24, a body 25, a series of small cavities 26 and a gear holder 28. The cavities 26 engage complementary knobs 16 in the top section 12 to help secure the two sections 12, 22 together. The top and bottom sections 12, 22 may be bonded together in any manner, preferably by ultrasonic welding. A barrier 30 defines part of the endless loop path of the ribbon 48, and also isolates the ink reservoir 112, from the ribbon 48. A bearing stem 32 engages the ink reservoir bearing 106 for holding the ink reservoir 112. A hole 34 is provided in the bottom section 22 to allow access to the advancing gear 52. A biasing barrier 36 is provided to bias a spring 118 against a holder 92 which in turn, biases a following gear 72 against the advancing gear 52. The barrier 36 includes side portions 38, 40, and a middle notch 42.

The ribbon 48 is an endless-loop ribbon which travels along a pathway that extends through the cartridge 10 and exits the cartridge at the arms 12, 24. The exposed portion of the ribbon 48 between the arms 14, is passed over the platen 3 (see FIG. 2) when the cartridge 10 is in place in the machine 1.

The advancing mechanism 50 generally comprises an advancing gear 52 and a following gear 72. The advancing gear 52 includes a cylindrical upper half 54 and a cylindrical lower half 56 separated by a middle portion 58. Side ridges 60 are located around the circumference of the upper half 54 and lower half 56. Bottom advancing teeth 62 are located along the bottom face of the lower half 56 and engage the pinion 66 when the cartridge 10 is in place inside the machine. A flange 46 is attached to the bottom portion 22 of the cartridge 10 and engages the advancing gear 52 in its middle portion 58 for loosely holding the advancing gear 52 in place. A cylindrical stem portion 64 in the upper half 54 of the advancing gear 52 is provided for engaging a complementary cavity (not shown) in the top portion 12 of the cartridge 10.

The following gear 72 is structurally similar to the advancing gear 52. The following gear 72 includes a cylindrical upper half 74 and a cylindrical lower half 76, with the two halves separated by a middle portion 78. Side ridges 80 are located along the outer circumference of the upper half 74 and lower half 76. A cylindrical stem portion 90 extends from the upper half. 74 for engaging a complementary cavity (not shown) in the top portion 12 of the cartridge 10.

A gear holder 92 holds the following gear 72 in place inside the cartridge 10. The gear holder 92 generally includes a gear notch 94, a spring knob 96 and a stabilizing stem 98. The gear notch 94 engages the middle portion 78 of the following gear 72. The spring 118 engages the spring knob 96 at one end of the spring 118. The other end of the spring 118 is biased against the barrier 36 and around the middle notch 42. Side portions 38, 40 of the spring barrier 36 limit the lateral movement of the spring 118 when the spring 118 is engaged over the notch 42. The stabilizing stem 98 generally includes a top portion 100 and a bottom portion 102. The top portion 100 of the stabilizing stem 98 engages a complementary cavity (not shown) in the top portion 12 of the cartridge 10. The bottom portion 102 of the stabilizing stem 98 engages a cavity 26 in the bottom portion 22 of the cartridge 10. Thus, the stabilizing stem 98 secures the gear holder 98 in place between the top portion 12 and the bottom portion 22 of the cartridge 10, thereby securing the following gear 72 in place inside the cartridge 10.

The ink reservoir 112 is preferably cylindrical and made from a reticulated and felted polyurethane foam having specific wicking properties. The reservoir 112 includes a stem opening 114 and an ink transfer surface 116 extending around the circumference of the reservoir 112. The ink reservoir 112 snugly engages the stem portion 108 of the bearing 106 through the opening 114. The flat bottom portion 110 of the bearing 106 contacts with the bottom portion of the ink reservoir 112. The bearing stem 108 is essentially hollow, thus, allowing it to fit over a stem 32 in the bottom portion 22 of the cartridge 10.

Materials and Dimensions

In the preferred embodiment, the body 11 is approximately 3 inches by 2 inches by 1¼ inches. The arms 13 are approximately 2 inches long and 1¼ inches in thickness. The advancing gear 52 is approximately ⅝ inches high and ½ inches in diameter. The side ridges 60 are preferably sized to fit approximately sixty ridges around the circumference of each cylindrical half, 54, 56 of the advancing gear 56. The ridges 60 can have a pitch of 120, a pressure angle of 20° and a pitch diameter of 0.500. The following gear 72 is preferably approximately ½ inches high and ⅜ inches in diameter. The side ridges. 80 are preferably sized to fit approximately 43 ridges around the circumference of each cylindrical half, 74, 76 of the following gear 72. The ridges 80 can have a pitch of 120, a pressure angle of 20° and a pitch diameter of 0.358. The ink reservoir 112 is approximately ½ inches high and 1½ inches in diameter. The ribbon 48 is approximately ⅜ inches wide and 10 inches in circumference.

The cartridge body 11 may be made from any lightweight yet sturdy material, and is preferably made from ABS plastic sold by General Electric. The small movable parts such as the gears 52, 72, holder 92 and bearing 106 are preferably a chemically inactive resin such as Delrin™ sold by DuPont.

The ink reservoir 112 is 90 pores per inch foam that is reticulated and compressed to a firmness rating of 6 (i.e., ⅙ its original volume). The foam has an 88% void volume and a wick height of 4.2 inches of oil in 72 hours. A suitable foam is available from a company known as Scott Foam having a place of business in Eddystone, Pennsylvania.

GENERAL OPERATION

In operation, the following gear 72 is spring biased against the advancing gear 52 which is in turn unbiased against the ink reservoir 112. The side ridges 60 of the advancing gear 52 engage the side ridges 80 of the following gear 72. The ribbon 48 is engaged between the side ridges 60, 80 of the advancing gear 52 and following-gear 72 respectively.

The ink reservoir 112 is filled with ink prior to assembly of the cartridge 10. This may be accomplished by exposing the reservoir to ink, in a dish for example, and waiting for the ink to migrate throughout the reservoir. As the advancing gear 52 is rotated by the pinion 66 in response to a keystroke, the ink reservoir 112 and bearing 106 are rotated around the bearing stem 32 by the advancing gear 52. The advancing gear 52 thus continuously contacts advancing portions of the ink reservoir 112, and the side ridges 60 of the advancing gear 52 carry ink to the ribbon 50.

Thus, the advancing mechanism 50 performs several functions. The advancing gear 52 advances the ribbon 48 in conjunction with the following gear 72. The advancing gear 52 also advances the ink reservoir 112, continuously contacting advancing portions of the ink reservoir 112 and carrying ink from the ink reservoir 112 to the ribbon 48. The coefficient of friction for the mechanism 50 is thus minimized since the elements that contact the advancing gear 52—namely the ink reservoir 112, the ribbon 48 and the following gear 72—all move with the advancing gear 52.

Also, ink is carried to the ribbon 48 in an even and metered fashion by the side ridges 60 of the advancing gear 52. There is no direct contact between the ribbon 48 and the ink reservoir 112, and thus the amount of ink transferred to the ribbon 48 is primarily controlled by 1) the size and spacing of the ridges 60; and 2) the wicking properties of the ink reservoir 112. By rotating the reservoir 112 as it picks up ink, the advancing gear 52 delivers a consistent and even amount of ink to the ribbon 48 over the useful life of the cartridge 10. Thus, the ribbon is not over-exposed to ink, and the ink stays in the ribbon rather than overflowing to the exterior of the cartridge creating a messy work area. Also, the cylindrical geometry of the rotating reservoir 112 mean that the maximum wicking distance to the ink transfer surface 116 is approximately equal to the radius of the cylinder 112.

Although the present invention has been described with reference to a preferred embodiment, it will be clear to one of ordinary skill in the art that certain rearrangements and modifications might be made within the scope of the invention. All such modifications and their equivalents are intended to be covered by the appended claims.

What is claimed is:

1. A ribbon cartridge for use in a shorthand machine, the cartridge comprising:

a cartridge housing having a main section and a pair of ribbon guide arms extending from said main section;

an endless loop ribbon having a substantially short total length extending through said main section, said guide arms, and a space between said guide arms;

said cartridge being configured such that said endless loop ribbon traveling therethrough does not contact itself and remains substantially perpendicular to a plane defined by said cartridge housing;

an ink reservoir;

an advancing gear situated within said housing having exposed drive teeth for engagement with a pinion external to the housing such that when a force moves said pinion, said advancing gear also moves to advance said endless loop ribbon; and said advancing gear contacting said ink reservoir for transferring ink from said ink reservoir to said endless loop ribbon, whereby said force required to move said pinion is minimized because of the substantially short endless loop ribbon, which does not contact itself and remains substantially perpendicular with respect to said plane, and the advancing gear being in moveable contact with said ink reservoir and said endless ribbon.

2. The invention defined in claim 1 wherein said ink reservoir is made from a reticulated and felted foam.

* * * * *

UNITED STATES PATENT AND TRADEMARK OFFICE

CERTIFICATE OF CORRECTION

PATENT NO. : 6,422,771 B1
DATED : July 23, 2002
INVENTOR(S) : Chvojcsek et al.

It is certified that error appears in the above-identified patent and that said Letters Patent is hereby corrected as shown below:

Title page,
Item [*], Notice: delete "0" and insert -- 998 --.

Signed and Sealed this

Twenty-sixth Day of August, 2003

JAMES E. ROGAN
*Director of the United States Patent and Trademark Office*